US007965928B2

(12) United States Patent
Eichholz et al.

(10) Patent No.: US 7,965,928 B2
(45) Date of Patent: Jun. 21, 2011

(54) PUMP, IN PARTICULAR FOR WATER-BEARING DOMESTIC APPLIANCES

(75) Inventors: Heinz-Dieter Eichholz, Iserlohn (DE); Hans-Juergen Kraffzik, Bielefeld (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 866 days.

(21) Appl. No.: 11/812,796

(22) Filed: Jun. 21, 2007

(65) Prior Publication Data

US 2008/0044168 A1 Feb. 21, 2008

(30) Foreign Application Priority Data

Jun. 21, 2006 (DE) ..... 10 2006 028 913

(51) Int. Cl.
*F24H 1/08* (2006.01)
*F24B 19/24* (2006.01)

(52) U.S. Cl. ..... 392/417; 417/208

(58) Field of Classification Search ..... 392/471, 392/465–470; 165/108–120; 417/208; 415/121.3; 239/128–139

See application file for complete search history.

(56) References Cited

U.S. PATENT DOCUMENTS

| | | | | |
|---|---|---|---|---|
| 2,257,011 | A | 9/1941 | Hillier | |
| 3,999,897 | A | 12/1976 | Strub | |
| 4,245,952 | A | 1/1981 | Eberhardt | |
| 4,361,750 | A * | 11/1982 | Miklas | 392/471 |
| 5,156,524 | A | 10/1992 | Forni | |
| 5,304,033 | A | 4/1994 | Tang | |
| 5,701,388 | A | 12/1997 | Steinhardt et al. | |
| 6,779,974 | B2 | 8/2004 | Chien | |
| 7,293,958 | B2 | 11/2007 | Kraffzik | |
| 2002/0048513 | A1 * | 4/2002 | Kleemann et al. | 415/175 |
| 2003/0113107 | A1 * | 6/2003 | Winter et al. | 392/447 |
| 2006/0137087 | A1 * | 6/2006 | Carreau et al. | 4/541.1 |
| 2006/0275114 | A1 | 12/2006 | Mangnall et al. | |

FOREIGN PATENT DOCUMENTS

| | | | |
|---|---|---|---|
| DE | 36 40 252 | A1 | 6/1988 |
| DE | 198 52 569 | A1 | 5/2000 |
| DE | 198 58 137 | A1 | 6/2000 |
| EP | 1 247 993 | A2 | 10/2002 |
| WO | WO 2006/027331 | A1 | 3/2006 |

* cited by examiner

*Primary Examiner* — Daniel Robinson
(74) *Attorney, Agent, or Firm* — Breneman & Georges

(57) ABSTRACT

The invention provides a pump, in particular for water-bearing domestic appliances such as dishwashers, washing machines or the like, comprising a pump housing and a heater device which is in thermal contact with the liquid-bearing interior of the pump housing. The pump according to the invention is simple and cost-effective to produce. For this reason, the pump housing (2) is produced at least partially from plastic, with the heater device (11, 12) being at least partially connected to the plastic in an interlocking manner.

12 Claims, 2 Drawing Sheets

PUMP, IN PARTICULAR FOR WATER-BEARING DOMESTIC APPLIANCES

CROSS REFERENCE TO RELATED APPLICATIONS

Figure 1:
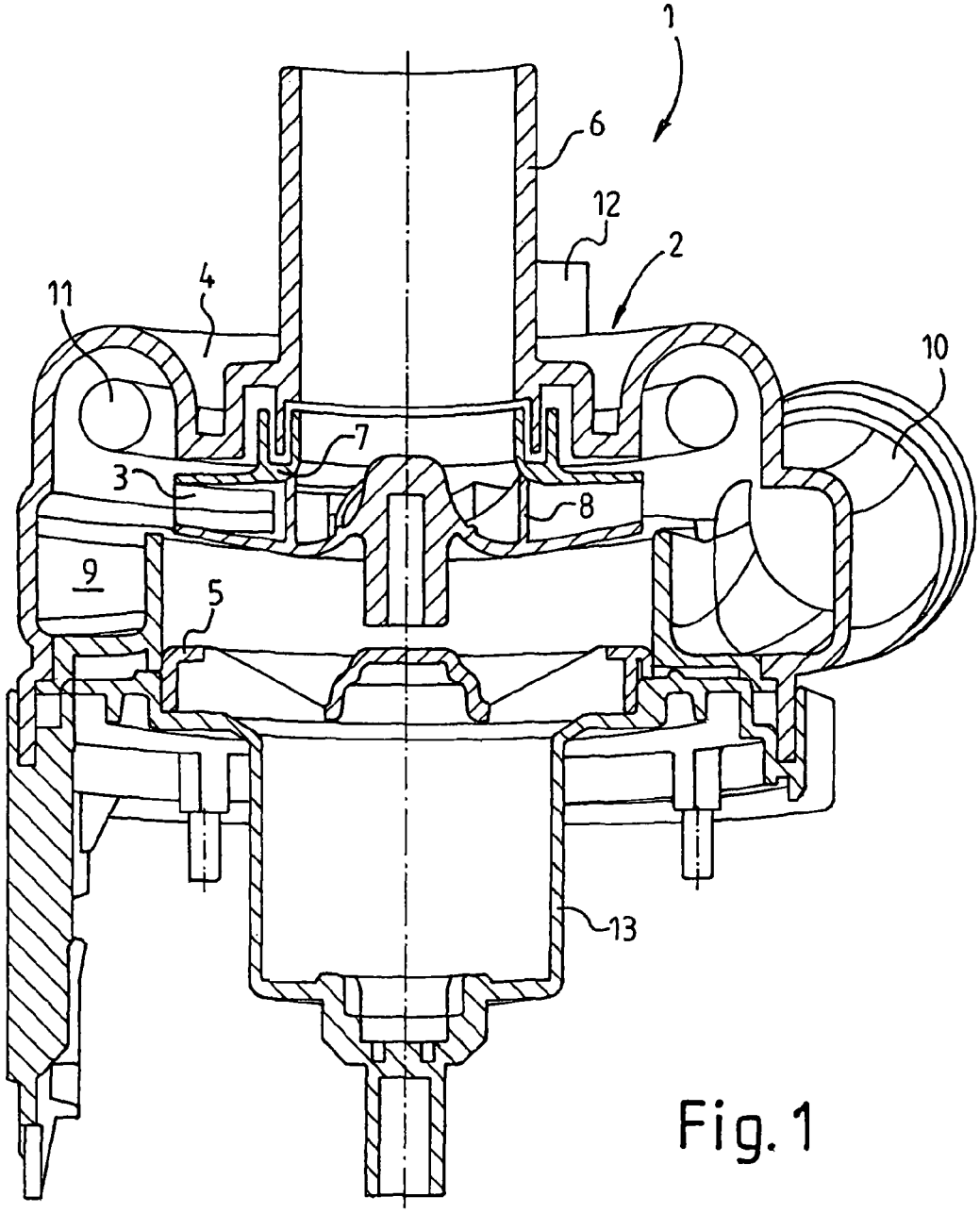

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION (1) Field of the Invention

The invention relates to a pump, in particular for water-bearing domestic appliances such as dishwashers, washing machines or the like having a pump housing and a heater device in thermal contact with the liquid-bearing interior of the pump housing. More particularly, the invention pertains to a pump housing composed at least partially of plastic with a heater device at least partially embedded in or connected to the plastic in an interlocking manner.

(2) Description of Related Art Including Information Disclosed Under 37 C.F.R. 1.97 and 1.98

Pumps which have a heater device which is in thermal contact with the liquid-bearing interior of the pump housing have been disclosed for water-bearing domestic appliances, such as dishwashers, washing machines or the like, and also, for example, for circulation pumps of Jacuzzis or the like. The heating pumps can be used to heat or maintain the temperature of the circulated liquid without a separate heater being required for this purpose.

The known heating pumps comprise so-called tubular heating bodies which are arranged either on the outside of the pump housing so as to be in thermally conductive contact or else in the interior, through which water flows, of the pump housing. In this case, at least that region of the pump housing which comprises the heating element is produced from a metal material, with the tubular heating body generally being soldered.

BRIEF SUMMARY OF THE INVENTION

Starting from this prior art, the object of the invention is to provide a heating pump which can be produced in a simple and cost-effective manner.

This object is achieved by a pump having a pump housing at least partially composed of plastic with a heater device that is at least partially connected or embedded in the plastic in an interlocking manner.

The advantageous embodiments and developments of the invention are further achieved by having the heater device injection molded to the plastic, having the heater device arranged in the interior of the pump housing, having the connection ends of the heater device pass through the plastic of the pump housing, having a heating zone of the heater device spaced at a distance from the plastic, having a heater device with a contact zone for contacting the plastic with a lower operating temperature than the operating temperature of the heating zone, having the heating device configured as a tubular body, having the heating element of the heating device surround an inlet connection piece, having the heating element of the heating device arranged in a flow channel of the pump housing, by having the cross section of the flow channel increase in size along the water course, by having the flow channel arranged radially outside a pump impeller and by having an axial offset of the heating device to the pump impeller.

The invention is accordingly distinguished in that the housing is composed at least partially of plastic and the heater device is at least partially connected to the plastic of the housing in an interlocking manner.

The connection of the heater device via the plastic of the pump housing makes integration of the heater device into the pump housing considerably simpler and therefore more cost-effective in terms of production.

The plastic of the pump housing is advantageously injection-molded to the heater device. The interlocking connection can therefore be formed by an injection process in one operation during production of the pump housing or of the housing part which is to be connected to the heater device. As a result, separate production processes for the connection and pump housing are dispensed with.

In one advantageous development of the invention, the heater device is arranged in the interior of the pump housing. This firstly provides the advantage that heat is not transferred from the heater device to the interior, through which liquid flows, of the pump housing via the plastic material of the pump housing but rather directly from the pump heater to the liquid in the interior of the pump housing. As a result, the requirements for temperature resistance of the plastic used for the pump housing are considerably lower since the pump housing is cooled by the flow of liquid while the liquid is heated.

In one particularly advantageous development of the invention, the heater device is arranged in the pump housing such that the connection ends of the heater device pass through the plastic of the pump housing. As a result, the heater device, with the exception of the connection ends, can be arranged at a distance from the plastic of the pump housing. The thermal load on the plastic is also reduced here.

In a further particularly advantageous embodiment of the invention, the heater device is formed such that it has a heating zone which is at a distance from the plastic. Heat is formed by the heater device primarily in this heating zone and therefore at a distance from the plastic. This in turn considerably limits the thermal load on the plastic which is attached to the heater device, preferably in the region of the connection ends, in an interlocking manner. As a result, firstly the plastic material can comprise a less heat-resistant material and secondly the risk of a defect due to excessive heating of the plastic can be reduced or completely avoided.

Furthermore, a heater device with a heating zone is preferably provided with a contact zone for making contact with the plastic of the housing, with the operating temperature of the contact zone being lower than the operating temperature of the heating zone. A contact zone such as this, which is in the form of a low-temperature zone, in turn protects the plastic in the region of the interlocking connection to the heater device against excessive temperature effects.

In conjunction with the abovementioned refining features of the invention, the low-temperature contact zone is advantageously provided in the region of the connection elements which bear against the plastic of the pump housing in an interlocking manner. The entire wall of the pump housing is preferably formed from plastic in this region and connection regions of the heater device which are in the form of a low-temperature contact zone pass through said wall.

The connection of the heater device can therefore be made outside the pump housing without problems. In this case, the heater device can be injected into the corresponding component of the pump housing at any desired position depending on the structural design of the pump housing. The heater device can accordingly be injected into a hollow in the pump housing which forms the pump chamber or else into a cover for closing a pump housing. The inventive interlocking connection of the heater device to a plastic region of the pump housing also enables connection in the region of the side walls.

In the case of a pump according to the invention, the heater device can, as in known heating pumps, comprise a tubular heating body as the heating element. Tubular heating bodies of this type have already proven advantageous when using heating pumps or throughflow heaters, firstly with regard to the heating effect and secondly with regard to electrical insulation.

One preferred arrangement of the heating device may involve the heating element of the heater device surrounding an inlet connection piece to the pump. This permits a design of the pump in which the heating element at least partially surrounds the end face of an axial inlet line. The arrangement comprising the pump motor, for example with a drive shaft being led through to a pump impeller, can then be arranged without problems on the opposite end face. In this case, the liquid to be pumped preferably washes around the heating element itself in the flow channel of said liquid to be pumped, with the result that optimum thermal contact is made.

A flow channel such as this can be formed in the pump housing by corresponding shaping. Specially formed flow channels which surround the pump impeller are advantageous in the case of centrifugal pumps. In particular, the shape, in particular the cross section, of a specially formed flow channel of this type can be matched to the pump impeller and said flow channel can be adapted for optimum pump behavior in terms of efficiency. A flow channel of this type is preferably formed with a cross section which increases in size in the direction of flow. This leads to a volumetric flow of the liquid, which is accelerated by the pump impeller and conveyed to the outside, in the flow channel which increases in the circulation direction. Such a refinement of the pump ensures a high degree of efficiency.

In another embodiment of the invention, an axial offset is furthermore provided between the heater device and the pump impeller. An arrangement of this type permits a certain distance between the pump impeller and the heater device, and it is therefore ensured that radially circulating liquid washes around the heater device effectively during the pumping process.

In addition to the described design variants, a very wide variety of types of pump configuration are possible using the invention. The essential feature here is always that the heater device is formed with a plastic region of the pump housing in an interlocking manner.

BRIEF DESCRIPTION OF THE SEVERAL VIEWS OF THE DRAWING(S)

Figure 2:
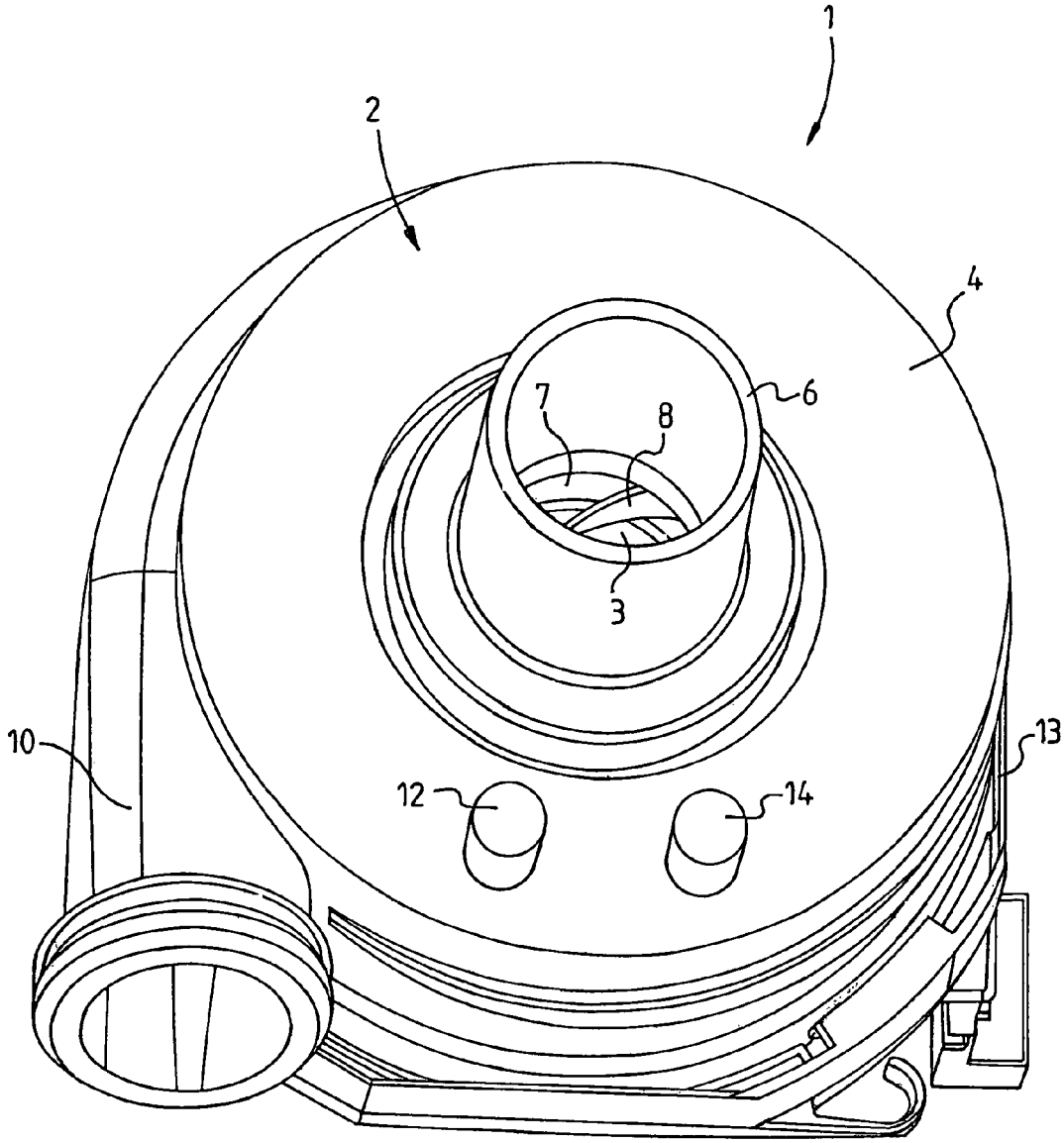

One exemplary embodiment of the invention is illustrated in the drawing and is explained in greater detail below with reference to the figures, in which FIG. 1 shows a perspective sectional illustration through a heating pump according to the invention, and FIG. 2 shows a perspective side view of a heating pump according to FIG. 1.

DETAILED DESCRIPTION OF THE INVENTION INCLUDING BEST MODE

The pump 1 according to FIG. 1 comprises a two-part pump housing 2. The hollow main part 4, which surrounds the pump chamber 3, of the pump housing 2 is closed by a cover 5. The main part 4 of the pump housing 2 comprises an inflow connection piece 6 which is arranged in an axial manner and meets a pump impeller 7. The pump impeller 7 is in the form of a hollow shape with pump vanes 8. The pump impeller 7 issues radially into a flow channel 9 which has a cross section which increases in size in the direction of the outflow connection piece 10. A tubular heating body in the form of a heating element 11 is arranged in the interior of the flow channel 9 in an axially offset manner in relation to the pump impeller 8 such that liquid flows around it on all sides. One of the connection elements 12, which passes through the wall of the main part 4, can be seen behind the inlet connection piece 6.

A motor housing 13 for accommodating a drive motor (not illustrated) for the pump impeller 7 adjoins the opposite side of a cover 5.

The two connection elements 12, 14 can be seen in the closed side view according to FIG. 2.

According to the invention, that part of the pump housing 2 which surrounds the heater device in an interlocking manner is produced from plastic. In the present exemplary embodiment, this is the main part 4 of the pump housing 2 through which the connection elements 12, 14 pass. In this case, the interlocking connection to the pump housing 2 is made in the region of these connection elements 12, 14. The heating element 11 is designed such that only the region which is at a distance from the pump housing 2 is formed as a heating zone. However, a low-temperature contact zone is formed in the region of the connections 12, 14 which pass through the wall of the pump housing 2, with the result that the plastic of the pump housing 2 or of the main part 4 of the pump housing 2 is subjected to a lower thermal load and the risk of a defect due to the pump housing melting in the region of the interlocking connection to the heating device is therefore prevented, even in the case of accidental dry-running of the pump with the heater switched on.

The heating pump according to the invention firstly permits an internal heating element with a heating element 11 around which liquid flows on all sides and at least in the region of the heating zone, as a result of which a greater degree of efficiency of the heating device is ensured together with good heat transfer. The interlocking connection to the plastic region of the housing ensures reliable leaktightness together with simple and therefore cost-effective production. In the case of a heating pump according to the invention, it is possible to inject the heating element into the housing in one injection process, as a result of which separate assembly steps and sealing measures in the region of the pump housing are dispensed with.

Furthermore, it is possible in the case of a pump according to the invention to also produce the entire pump housing from plastic, as a result of which both expenditure on forming the pump housing and expenditure on material for the pump housing can be considerably reduced. The advantages according to the invention are available particularly in the case of large numbers of items, as are present when used in domestic appliances such as washing machines or dishwashers. However, another advantageous application of the invention, for example as a circulation pump of a Jacuzzi or the like, is entirely feasible.

LIST OF REFERENCE SYMBOLS

1 Pump
2 Pump housing
3 Pump chamber
4 Main part
5 Cover
6 Inflow connection piece
7 Pump impeller
8 Pump vane
9 Flow channel
10 Outlet connection piece
11 Heating element
12 Connection element
13 Motor housing
14 Connection element

What is claimed is:

1. In a pump for water-bearing domestic appliances having a pump housing and a heater device disposed in thermal contact with a liquid-bearing interior of the pump housing, wherein the improvement comprises a pump housing (2) comprised of a plastic with the heater device (11, 12, 14) at least partially embedded in the plastic in an interlocking manner, said heater device having a heating element surrounding an inlet connection piece (6) to the pump housing and wherein the heater device has a contact zone for making contact with the plastic of the pump housing in which an operating temperature of the contact zone is lower than an operating temperature of a heating zone.

2. The pump according to claim 1, wherein the plastic is injection-molded to the heater device (12, 14).

3. The pump according to claim 1 or 2 wherein a portion of the heater device is arranged in a flow channel in the interior of the pump housing (2).

4. The pump according to claim 1 or 2 further comprising connection ends (12, 14) to the heater device wherein the connection ends (12, 14) of the heater device pass through the plastic of the pump housing (2).

5. The pump according to claim 1 or 2 wherein the heater device has a heating zone which is disposed at a distance from the plastic.

6. The pump according to claim 1 or 2 wherein the heater device has a tubular heating body as the heating element.

7. The pump according to claim 1 or 2 wherein a portion of the heater device is arranged in a flow channel (9) of the pump housing (2).

8. The pump according to claim 1 or 2 wherein the flow channel (9) is arranged radially outside a pump impeller (7).

9. The pump according to claim 1 or 2 further comprising a pump impeller and wherein the heater device (11) has an axial offset in relation to the pump impeller (7).

10. A water pump for a domestic appliance having a pump housing, an impeller, a flow channel disposed in said pump housing and a heating element disposed in said flow channel wherein the improvement comprises a pump housing completely constructed of plastic and a heating element with at least one portion of the heating embedded in a plastic portion of said pump housing and with said heating element surrounding an inlet connection piece of said pump housing.

11. A water pump for a water appliance comprising:

(a) a water pump housing partially or completely constructed of plastic;

(b) a water flow channel disposed in said water pump housing having a cross section of said water flow channel that increases in size from an inlet to an outlet;

(c) a water pump impeller disposed in said water flow channel; and (d) a heating element disposed partially in said water flow channel and extending out of said water flow channel through a plastic portion of said water pump housing.

12. In a pump for water-bearing domestic appliances having a pump housing and a heater device disposed in thermal contact with a liquid-bearing interior of the pump housing, wherein the improvement comprises a pump housing (2) comprised of plastic and with the heater device (11, 12, 14) at least partially embedded in the plastic in an interlocking manner and with a flow channel disposed in said pump housing having a cross section that increases in size from an inlet to an outlet and wherein the heater device has a contact zone for making contact with the plastic of the pump housing in which an operating temperature of the contact zone is lower than an operating temperature of a heating zone.

* * * * *